US007867042B2

(12) United States Patent
Shuey

(10) Patent No.: US 7,867,042 B2
(45) Date of Patent: Jan. 11, 2011

(54) CONNECTOR ASSEMBLY WITH A LOW PROFILE TERMINAL POSITION ASSURANCE MEMBER

(75) Inventor: John R. Shuey, Mechanicsburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/409,621

(22) Filed: Mar. 24, 2009

(65) Prior Publication Data

US 2009/0247000 A1 Oct. 1, 2009

Related U.S. Application Data

(60) Provisional application No. 61/070,863, filed on Mar. 26, 2008.

(51) Int. Cl.
*H01R 13/514* (2006.01)

(52) U.S. Cl. ..... 439/752; 439/595

(58) Field of Classification Search ..... 439/752, 439/595

See application file for complete search history.

(56) References Cited

U.S. PATENT DOCUMENTS 5,261,836 A 11/1993 Okabe
7,066,773 B1 * 6/2006 Martin ..... 439/752

FOREIGN PATENT DOCUMENTS

EP 0600469 6/1994
WO WO 99/13534 3/1999

OTHER PUBLICATIONS

International Search Report, International Application No. PCT/US2009/001858, International Filing Date, Mar. 25, 2009.

* cited by examiner

*Primary Examiner*—Ross N Gushi

(57) ABSTRACT

An electrical connector assembly is described which has an electrical connector housing and a TPA. The electrical connector housing has terminal receiving cavities with openings which access the cavities. Latching projections are located within the openings. A TPA is insertable into the electrical connector housing and has latching which cooperates with the latching projections.

18 Claims, 6 Drawing Sheets

CONNECTOR ASSEMBLY WITH A LOW PROFILE TERMINAL POSITION ASSURANCE MEMBER

RELATED APPLICATION

This application claims priority from Provisional patent application Ser. No. 61/070,863 filed Mar. 26, 2008.

FIELD OF THE INVENTION

The present invention generally relates to electrical connectors, and more particularly to a connector assembly having a low profile terminal position assurance member ("TPA") for assuring the proper loading of electrical terminals.

It is known in the electrical connector art to provide TPAs which assure that an the electrical terminal or contact is fully positioned before installing the fully loaded connector assembly into its end application. Such assemblies having TPAs find substantial utility in automotive use as a terminal or contact which is not fully loaded in the connector, can cause an open circuit in a automotive harness. This in turn can cause substantial cost and effort to isolate and fix the problem. Such a TPA is normally insertable into the electrical connector housing to a position where it lies adjacent to a terminal latching device. It is also common to have a TPA which is insertable through a front face of a connector housing and which can only be fully inserted if the terminal itself is fully inserted, and when the terminal latch within the housing is in its terminal locked position.

Normally, some type of latching mechanism on the TPA device latches the TPA in multiple positions; at least in a first position where the TPA is not fully inserted and where the terminals may be inserted, and a second position where the terminal position is fully locked, thereby assuring that the terminals are fully loaded. The addition of the latching adds some complexity to the design of the electrical connector, in particularly to the TPA, in that the overlapping latching surfaces require a certain amount of vertical or horizontal space in order for the latching to occur. This extra space results in a larger volume for the entire connector interface, which may not be available given certain designs or certain preexisting interfaces.

SUMMARY OF THE INVENTION

The shortcomings of the prior art have been advanced by providing an electrical connector assembly, comprising an electrical connector housing having at least one terminal receiving cavity extending between a front face and a receiving face. The electrical connector housing comprises an open area adjacent the terminal receiving cavity, and a terminal retaining latch positioned adjacent to the terminal receiving cavity. A terminal positioning assurance member (TPA), is receivable in the electrical connector housing and has a latching mechanism which operates within the open area, and retains the TPA in first and second positions, where in the first position an electrical terminal may be positioned within the terminal receiving cavity, and in a second position the TPA assures that the terminal is in a fully loaded position.

In another embodiment, an electrical connector assembly, comprises an electrical connector housing having at least one terminal receiving cavity extending between a front face and a receiving face, where the terminal receiving cavity has an upper wall defining at least a portion of the terminal receiving cavity. The electrical connector housing comprises an open slot within the wall with a retaining edge formed in the slot, and a terminal retaining latch positioned adjacent to the terminal receiving cavity. A terminal positioning assurance member (TPA) is receivable in the electrical connector housing and has a latching mechanism which operates within the slot, and retains the TPA in first and second positions, where in the first position an electrical terminal may be positioned within the terminal receiving cavity, and in a second position the TPA assures that the terminal is in a fully loaded position.

In yet another embodiment, an electrical connector assembly comprises an electrical connector housing having a plurality of terminal receiving cavities extending between a front face and a receiving face, where each terminal receiving cavity has an upper wall defining at least a portion of the terminal receiving cavity. The electrical connector housing comprises a plurality of slots within the upper wall which is aligned with each terminal receiving cavity. A retaining edge is formed in each of the slots, and a terminal retaining latch is positioned adjacent to the terminal receiving cavity. A terminal positioning assurance member (TPA) is receivable in the electrical connector housing and has a latching mechanism which operates within the slots. The TPA conforms to the electrical connector housing and defines a portion of the front face and the terminal receiving cavity.

BRIEF DESCRIPTION OF THE DRAWINGS

The electrical connector assembly will now be described by way of reference to the drawing figures, where.

DETAILED DESCRIPTION OF THE DRAWINGS

Figure 1:
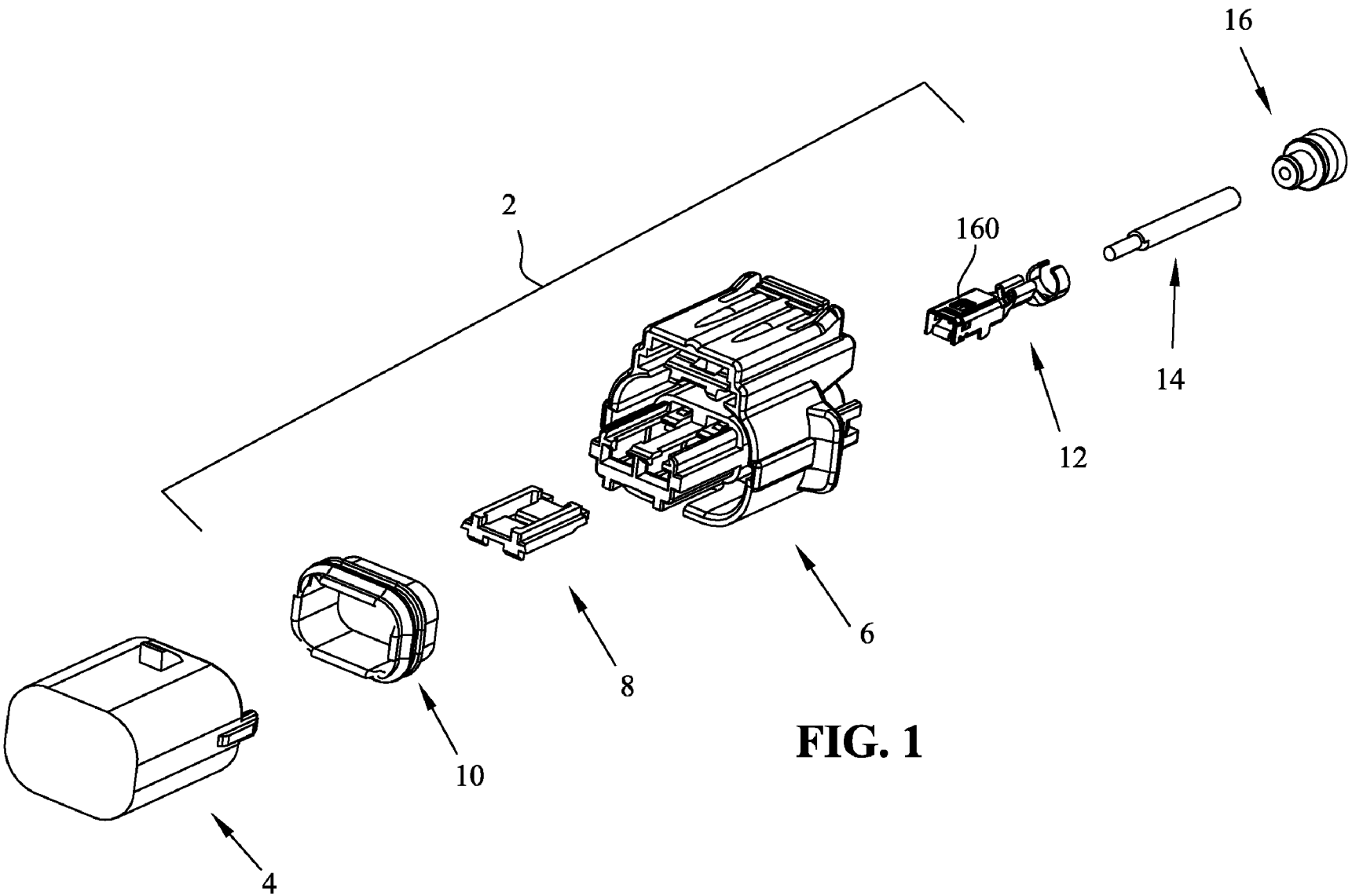
FIG. 1 is a perspective view of the electrical connector assembly shown poised for receiving an electrical contact and poised for receiving the TPA through a front face thereof.

With reference first to FIG. 1, an electrical connector assembly is shown at 2 which is connectable to a device such as 4. The electrical connector assembly 2 may be comprised of such components as an electrical connector housing 6, a terminal positioning assurance member (TPA) 8, a peripheral seal 10 and an electrical terminal as shown at 12. It should be understood that an insulated wire such as 14 would be terminated to the electrical terminal 12, which may also include a discreet seal such as item 16. With the components generally described, the various details of the components will now be described with greater detail.

Figure 2:
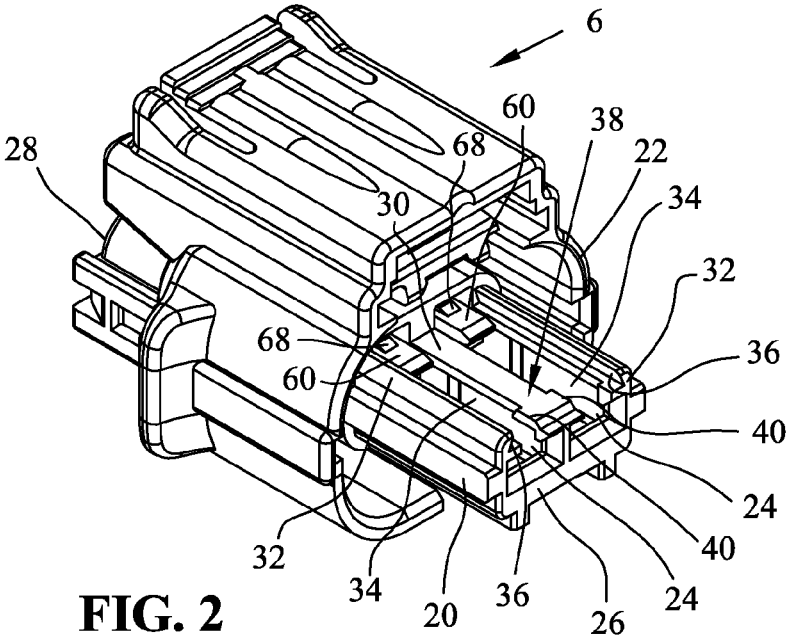
FIG. 2 is a front perspective view of the electrical connector housing of the electrical connector assembly shown in FIG. 1.
Figure 3:
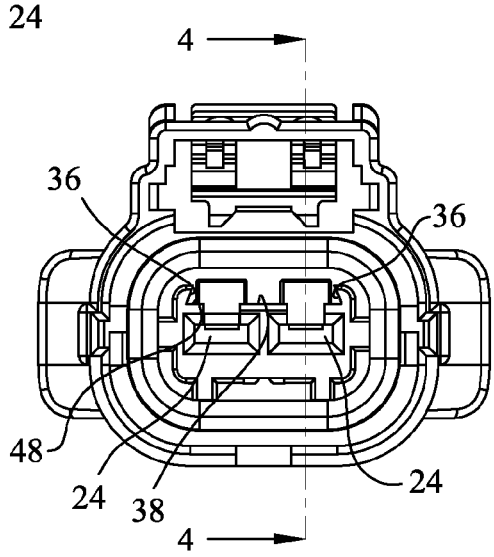
FIG. 3 shows a front plan view of the electrical connector housing of FIG. 2.

With reference now to FIGS. 2 and 3, the electrical connector housing 6 will be described in greater detail. As shown, electrical connector housing 6 is generally comprised of a central body portion 20 which is surrounded by a shroud portion at 22. The central body portion 20 has terminal receiving cavities such as 24 which extend between a front face 26 and a receiving face 28. The central body portion 20 is also defined by an interruption or cut away portion 30 which extends through wall 32, and into the terminal receiving cavities 24. This also defines open areas 34, which may be defined by slots which are longitudinally aligned with the terminal receiving cavities 24. Interruption 30 is rectangular in configuration and extends between side edges defined as dovetail surfaces 36.

Figure 4:
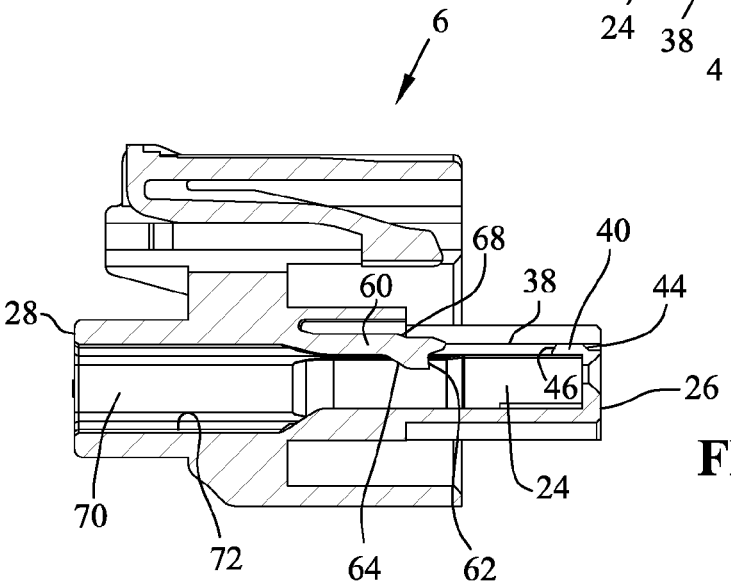
FIG. 4 shows a cross-sectional view through lines 4-4 of FIG. 3.

As shown best in FIG. 4, open areas 34 flank an upper wall in the form of a rib 38 which has projections 40 on either side edge thereof and extend into the slot 34. Each projection 40 defines a retaining member and has a forwardly facing surface or edge 44 and a rearwardly facing retaining surface or edge 46. As shown best in FIG. 3, the top of rib 38 is planar with surfaces 48 which together with dovetail surfaces 36 define corners of the interruption 30.

With respect again to FIG. 4, a terminal retaining latch 60 is shown extending into and adjacent to the terminal receiving cavity 24, and has a forwardly facing shoulder 62 for retaining electrical terminal 12 (FIG. 1) and a camming surface 64 as will be described in greater detail. As best shown in FIGS. 2 and 4, terminal retaining latch 60 includes a camming rib 68, as will be described more fully herein. Electrical connector housing 6 further includes a rear cavity portion 70 having an inside diameter 72 profiled to receive electrical terminal 12 (FIG. 1) therethrough and to cooperate with discreet seal 16 (FIG. 1).

Figure 5:
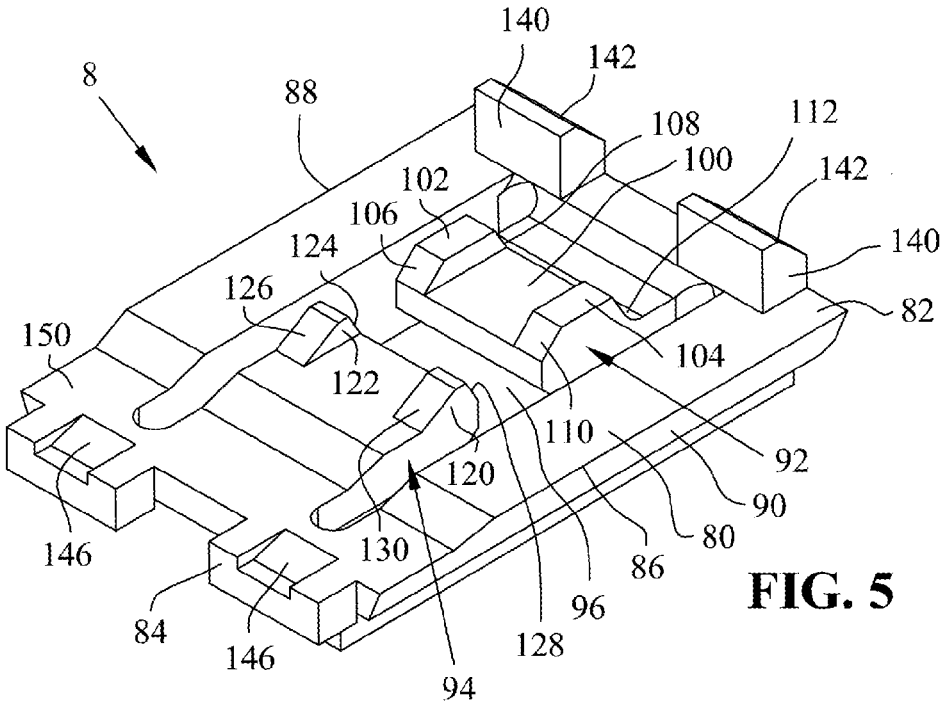
FIG. 5 shows a perspective view of the TPA.
Figure 6:
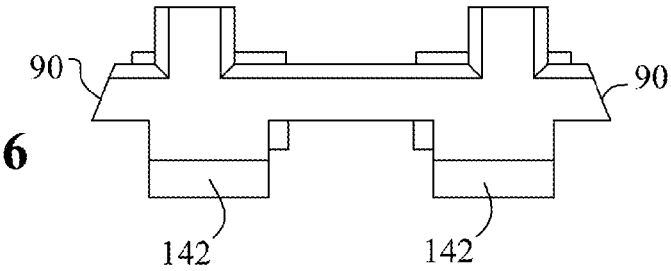
FIG. 6 shows an end view of the TPA shown in FIG. 5.
Figure 7:
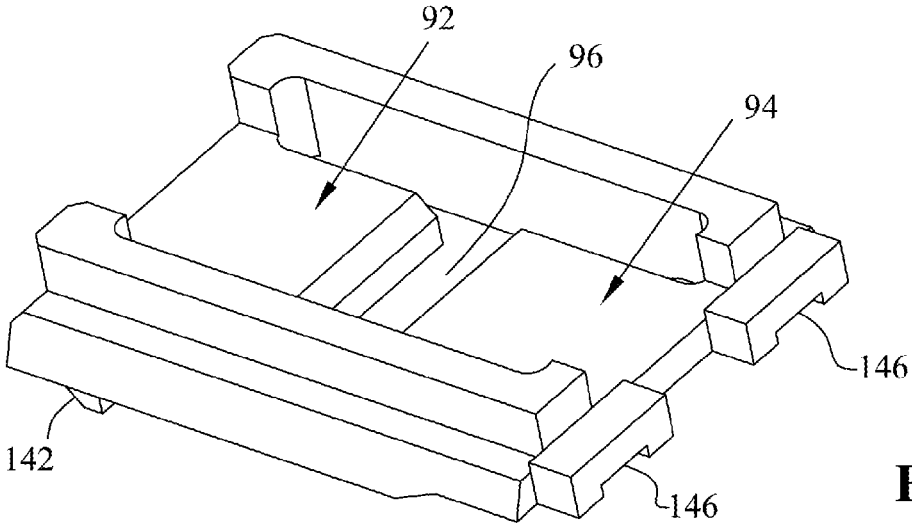
FIG. 7 shows a perspective view of the opposite side of the TPA as shown in FIG. 5.
Figure 8:
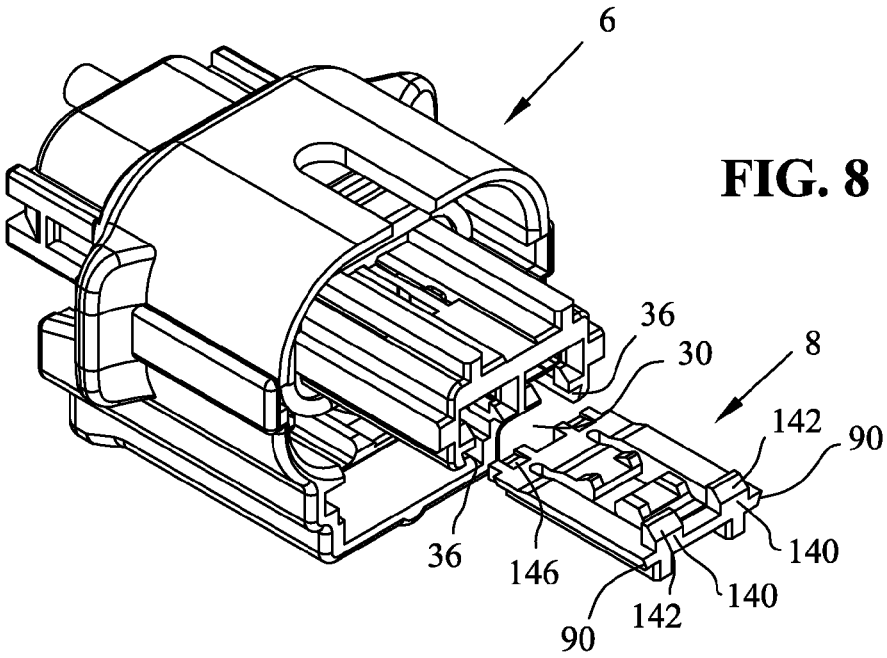
FIG. 8 shows the electrical connector housing of FIG. 2 poised for receiving the TPA.
Figure 9:
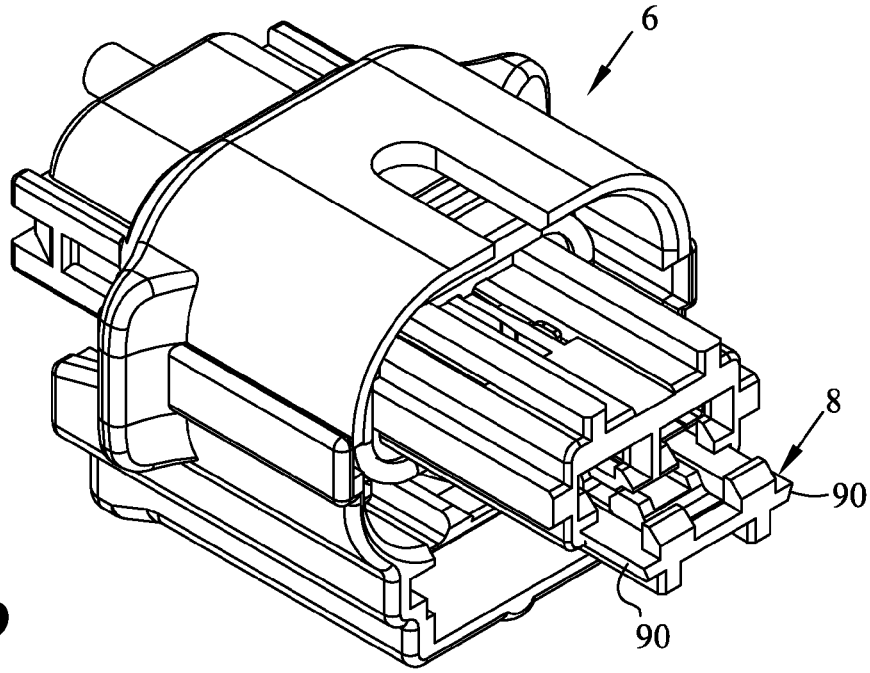
FIG. 9 shows the TPA in a first pre-locked position where electrical terminals may be received therein.
Figure 10:
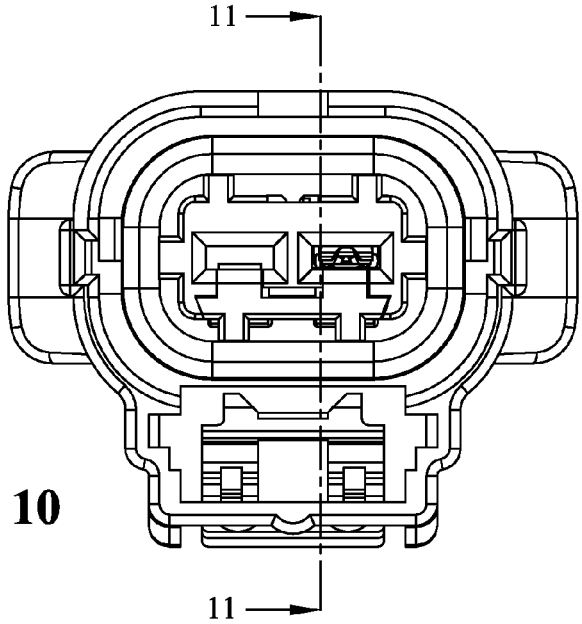
FIG. 10 is a front perspective view of the assembly of FIG. 9.

With reference now to FIGS. 5, 6 and 7, TPA 8 will be described in greater detail. TPA 8 is generally comprised of a planar body portion 80 having an outer or front end 82, an inner end 84, and sidewalls 86 and 88. The sidewalls 86 and 88 have side edges defined as dovetail surfaces 90 as best shown in FIG. 6, which cooperate with dovetail surfaces 36 on electrical connector housing 6 as will be described. TPA 8 further includes a latching mechanism comprised of cantilever latches 92 and 94 which are cantilevered from respective ends 82 and 84 and define a space 96 therebetween. The latching mechanism formed by cantilever latches 92 and 94 is in substantial planarity with the planar body portion 80. Cantilever latch 92 is comprised of a cantilever beam 100 having latching catches 102 and 104. Latching catch 102 has latching surfaces 106 and 108, whereas latching catch 104 includes latching surfaces 110 and 112. Meanwhile, cantilever latch 94 includes latching catches 120 and 122 having latching surface 124 and ramp 126 whereas latching catch 120 includes latching surface 128 and ramp 130.

With respect still to FIG. 5, TPA 8 and more particularly front end 82 includes extension portions 140 having lead-in surfaces 142 as will be described herein. On the opposite inner end 84, camming surfaces 146 are provided which have a width which is complementary to the width of camming ribs 68 (FIG. 2) and as also will be described with further detail herein. Finally, a backup surface 150 is provided at the inner end 84 which is used for maintaining terminal retaining latch 60 in a locked position.

Figure 11:
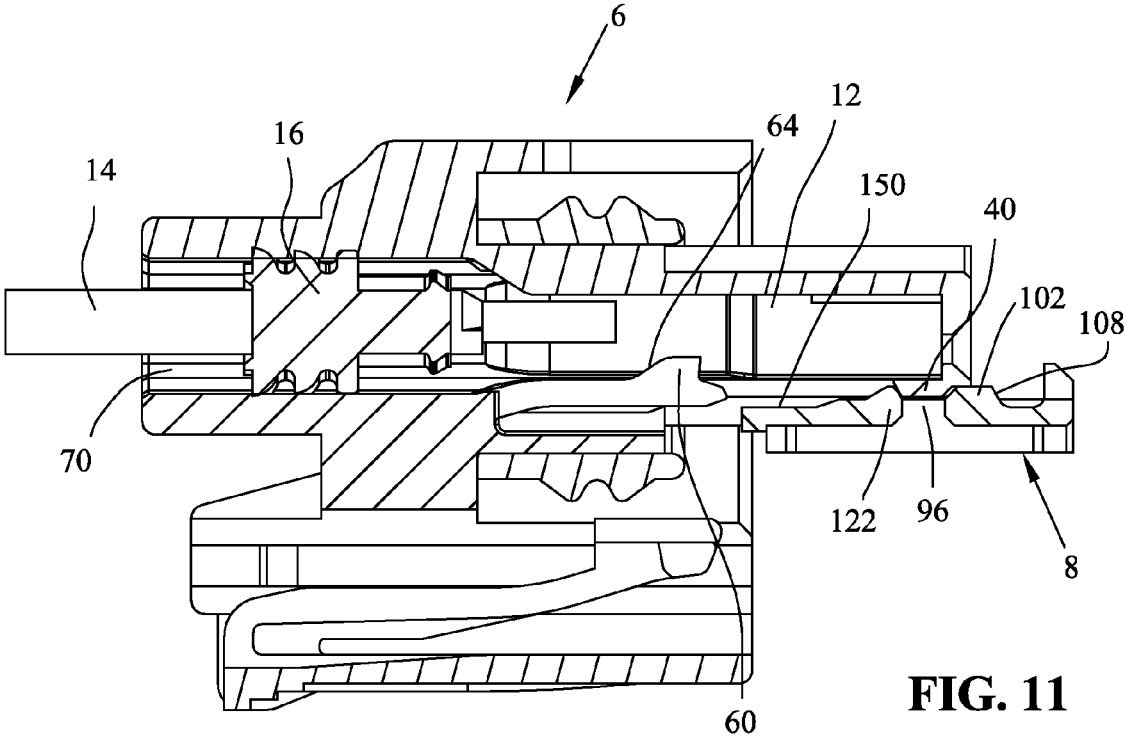
FIG. 11 is a cross-sectional view taken through lines 11-11 of FIG. 10.

With reference now to FIGS. 8 through 13, the assembly and use of the electrical connector assemblies will be described. As shown first in FIG. 8, TPA 8 would be presented to the front of the electrical connector housing 6 and more particularly, TPA 8 would be presented to the interruption 30 with the dovetail surfaces 36 and 90 in a complementary fashion. It should be appreciated that TPA is profiled in a complementary manner as the interruption 30, such that once the dovetail surfaces 36, 90 are aligned, TPA 8 will slide inwardly to the position shown in FIG. 9. It should also be appreciated that the latching catches 102, 122 and 104, 120 (FIG. 5) flank the rib 38, align with slots 34 (FIG. 2), and are profiled to contact projections 40 (FIG. 2), to define a first and pre-locked position of the TPA 8. This is best shown in FIG. 11 where projection 40 is latched in space 96 and between latching catches 102 and 122, and latching catches 102, 122 are within the slot 34.

More particularly, when in the position of FIG. 11, it should be appreciated that surfaces 44 and 46 (see FIG. 4) are trapped between latch surfaces 106, 124 (see FIG. 5). When in this position, and as shown in FIG. 11, terminal 12, insulated wire 14 and discrete seal 16 may be inserted into rear cavity portion 70 whereby the front end of electrical terminal 12 will contact camming surface 64 of terminal retaining latch 60, resiliently biasing the latch 60 down until the electrical terminal 12 is fully positioned therein. Latch 60 then biases back where it is received in an opening of the terminal such as opening 160 (FIG. 1). As TPA 8 is only part way inserted, latch 60 may bias downwardly to accept terminal 12 therein. If terminal 12 is not fully inserted into the terminal receiving cavity 24, retaining latch 60 remains in a deflected position, and the front end of retaining latch 60 prevents passage of end 84. Therefore TPA 8 cannot be moved to the fully locked position. This is intentional to indicate a partially inserted terminal.

Figure 12:
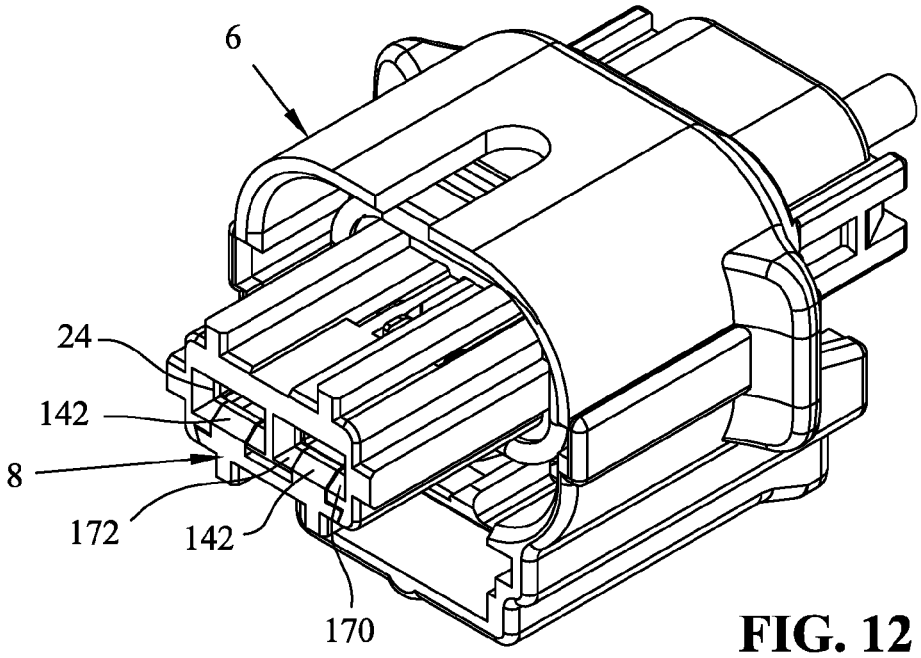
FIG. 12 shows a perspective view of the connector assembly with the TPA fully installed.
Figure 13:
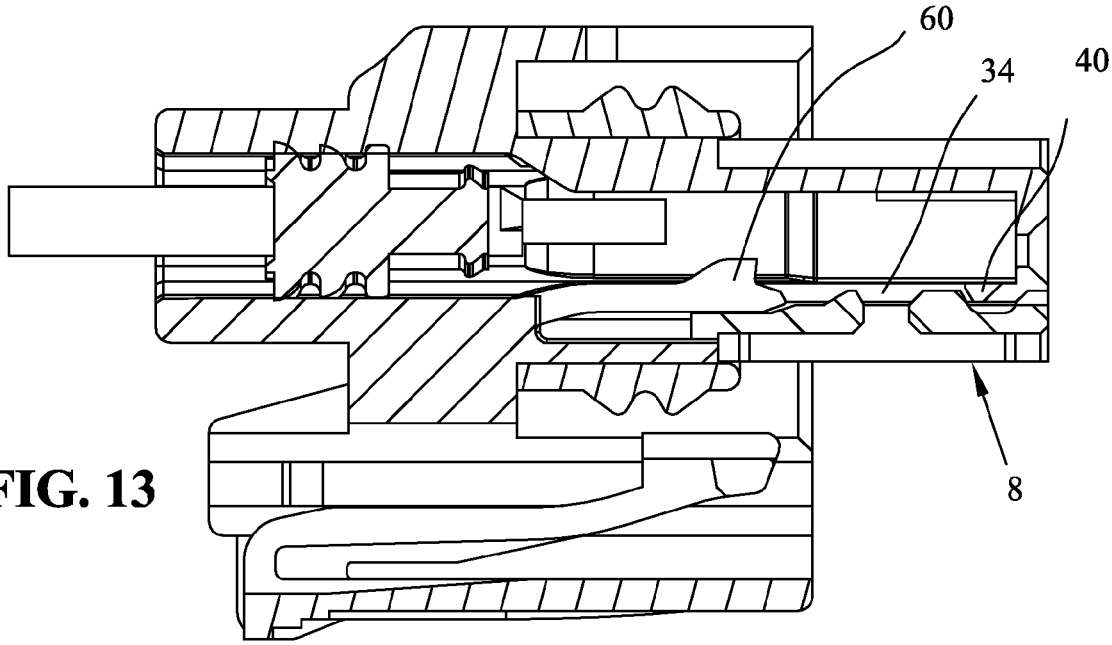
FIG. 13 shows a cross-sectional view similar to that of FIG. 11 with the TPA member fully installed.

Continued movement of TPA 8 into electrical connector housing 6, into the position shown in FIG. 12, causes backup surface 150 (FIG. 11) to be received under terminal retaining latch 60 with surfaces 146 (FIG. 5) preventing any stubbing between TPA 8 and terminal retaining latches 60, and into the position shown in FIG. 13. In the second and fully inserted position, and as shown in FIG. 13, surface 108 is positioned against surface 46 to maintain the TPA in the fully inserted position. When in the fully inserted position of FIGS. 12 and 13, TPA 8 prevents latch 60 from flexing to an open position to allow terminal to be retracted.

TPA 8 also provides complementary surfaces to the electrical connector housing 6. More particularly, and as shown in FIG. 12, lead-in surfaces 142 on extension portions 140 align with the lead-in surfaces 170, 172 providing a complementary lead-in surface for a mating contact tab (not shown) which is inserted into the cavities 24. Furthermore, as the projections 40 are provided on the side edges of slot 34, the latching catches 102, 104, 120, 122, operate within the area defined by the slot 34 thereby minimizing the volume of space required in the vertical direction (as viewed in FIG. 13) thus minimizing the overall profile of the electrical connector 2.

What is claimed is:

1. An electrical connector assembly, comprising:

an electrical connector housing having at least one terminal receiving cavity extending between a front face and a receiving face, the electrical connector housing comprising an open area adjacent the terminal receiving cavity, and a terminal retaining latch positioned adjacent to the terminal receiving cavity; and a terminal positioning assurance member (TPA), receivable in the electrical connector housing and having a latching mechanism which operates within the open area, the latching mechanism being comprised of first and second latches in alignment along a longitudinal axis, and in tandem relation, and retains the TPA in first and second positions, where in the first position an electrical terminal may be positioned within the terminal receiving cavity, and a second position where the TPA assures that the terminal is in a fully loaded position.

2. The connector assembly of claim 1, wherein the open area is formed by a slot in the electrical connector housing longitudinally aligned with the terminal receiving cavity.

3. The connector assembly of claim 2, wherein the slot extends from the front face to a position adjacent to the terminal retaining latch.

4. The connector assembly of claim 3, wherein at least one retaining member extends from a side edge of the slot, and extends into the slot.

5. The connector assembly of claim 4, wherein the TPA is comprised of a planar body portion substantially planar in configuration with the latching mechanism being in substantial planarity with the plane of the planar body portion.

6. The connector of claim 5, wherein the at least one retaining member is comprised of a projection which extends from a side surface of said slot and comprises forwardly and rearwardly facing surfaces.

7. The connector of claim 6, wherein the first and second latches comprise two cantilever latches extending towards each other and in substantial lateral alignment with the terminal receiving cavity and having latching catches which define a space therebetween, the space capturing the projection when in the first position.

8. An electrical connector assembly, comprising:

an electrical connector housing having at least one terminal receiving cavity extending between a front face and a receiving face, the terminal receiving cavity having an upper wall defining at least a portion of the terminal receiving cavity, the electrical connector housing comprising a slot extending through the upper wall and longitudinally along at least a portion of the terminal receiving cavity with a retaining edge formed in, and by a surface of, the slot, and the retaining edge extending transverse to the longitudinal direction, and a terminal retaining latch positioned adjacent to the terminal receiving cavity; and a terminal positioning assurance member (TPA), receivable in the electrical connector housing and having a latching mechanism being movable longitudinally within the slot and in latching engagement with the retaining edge, and retains the TPA in first and second positions, where in the first position an electrical terminal may be positioned within the terminal receiving cavity, and a second position where the TPA assures that the terminal is in a fully loaded position.

9. The connector assembly of claim 8, wherein the slot extends from the front face to a position adjacent to the terminal retaining latch.

10. The connector assembly of claim 9, wherein the TPA is comprised of a planar body portion and with the latching mechanism being in substantial planarity with the plane of the planar body portion.

11. The connector of claim 10, wherein the retaining edge is comprised of a projection having forwardly and rearwardly facing surfaces.

12. The connector of claim 11, wherein the latching mechanism is comprised of two cantilever latches extending towards each other and in substantial planarity with the TPA, in substantial longitudinal alignment with the terminal receiving cavity and defining a space therebetween, the space capturing the projection when in the first position.

13. An electrical connector assembly, comprising:

an electrical connector housing having a plurality of terminal receiving cavities extending between a front face and a receiving face, each terminal receiving cavity having an upper wall defining at least a portion of the terminal receiving cavity, the electrical connector housing comprising a plurality of slots within the upper wall and aligned with each terminal receiving cavity, with a retaining edge formed in each of the slots, and a terminal retaining latch positioned adjacent to the terminal receiving cavity, wherein the at least one retaining edge is comprised of a projection which extends from a side edge of said slot and comprises forwardly and rearwardly facing surfaces; and a terminal positioning assurance member (TPA), receivable in the electrical connector housing and having a latching mechanism which operates within the slots, and the TPA conforming to the electrical connector housing and defining a portion of the front face and the terminal receiving cavity, the TPA being comprised of a member substantially planar in configuration with the latching mechanism and being in substantial planarity with the plane of the TPA.

14. The connector assembly of claim 13, wherein the slots in the electrical connector housing are longitudinally aligned with the terminal receiving cavity.

15. The connector assembly of claim 14, wherein the electrical connector housing is substantially interrupted above the plurality of terminal receiving cavities and the TPA is conformed to the profile of the interruption.

16. The connector assembly of claim 15, wherein the interruption is defined by conforming side edges with a like profile as the TPA.

17. The connector assembly of claim 16, wherein the conforming side edges are dovetail shaped and interlock with complementary side edges of the TPA.

18. The connector of claim 13, wherein the latching mechanism is comprised of two cantilever latches extending towards each other and in substantial planarity with the TPA, in substantial longitudinal alignment with the terminal receiving cavity and defining a space therebetween, the space capturing the projection to define a first position, wherein in the first position a terminal may be positioned within the terminal receiving cavity, and in a second position the TPA assures that the terminal is in a fully loaded position.

* * * * *